US010669830B2

(12) United States Patent
Facca et al.

(10) Patent No.: US 10,669,830 B2
(45) Date of Patent: Jun. 2, 2020

(54) APPARATUS, SYSTEMS AND METHODS FOR MULTI-STAGE STIMULATION

(71) Applicant: National Oilwell Varco, L.P., Houston, TX (US)

(72) Inventors: Lewis Facca, Calgary (CA); Graham Styler, Calgary (CA); Andrew Sushko, Calgary (CA); William Tait, Calgary (CA); D. J. Radmanovich, Calgary (CA); Mike Bellavance, Calgary (CA)

(73) Assignee: National Oilwell Varco, L.P., Houston, TX (US)

( * ) Notice: Subject to any disclaimer, the term of this patent is extended or adjusted under 35 U.S.C. 154(b) by 159 days.

(21) Appl. No.: 15/756,789

(22) PCT Filed: Sep. 6, 2016

(86) PCT No.: PCT/US2016/050426
§ 371 (c)(1),
(2) Date: Mar. 1, 2018

(87) PCT Pub. No.: WO2017/041105
PCT Pub. Date: Mar. 9, 2017

(65) Prior Publication Data

US 2018/0347330 A1 Dec. 6, 2018

Related U.S. Application Data

(60) Provisional application No. 62/214,843, filed on Sep. 4, 2015.

(51) Int. Cl.
*E21B 43/26* (2006.01)
*E21B 34/14* (2006.01)
(Continued)

(52) U.S. Cl.
CPC ..... *E21B 43/26* (2013.01); *E21B 34/14* (2013.01); *E21B 43/08* (2013.01); *E21B 2034/007* (2013.01)

(58) Field of Classification Search
CPC ..... E21B 34/007; E21B 34/06–34/14
See application file for complete search history.

(56) References Cited

U.S. PATENT DOCUMENTS 4,098,334 A * 7/1978 Crowe ..... E21B 23/06 166/182
4,260,017 A * 4/1981 Nelson ..... E21B 34/14 166/154
(Continued)

FOREIGN PATENT DOCUMENTS

GB 2503627 A 1/2014
GB 2522264 A 7/2015
(Continued)

OTHER PUBLICATIONS

International Patent Application No. PCT/US2016/050426 International Search Report and Written Opinion dated Dec. 5, 2016 (13 pages).
(Continued)

*Primary Examiner* — William D Hutton, Jr.
*Assistant Examiner* — Steven A MacDonald
(74) *Attorney, Agent, or Firm* — Conley Rose, P.C.

(57) ABSTRACT

Embodiments of a sleeve assembly, used for stimulating multiple stages in a completion string has a lower shifting sleeve and an upper shifting sleeve and stimulation ports formed therebetween. The sleeves are caused to shift by progressively larger objects pumped through a bore of the completion string and engaging seats formed thereon. The seat on the lower sleeve is a releasable seat. When shifted the lower sleeve opens the stimulation ports. The seat on the upper sleeve is sized to accept the same size object as is
(Continued)

required to engage and shift the lower sleeve on the stage uphole therefrom to close the ports. Thereby, stimulation ports are opened and closed without increasing a number of objects required to stimulate the wellbore. Further, as the ports at each stage below the stage being stimulated are closed, the objects are not required to isolate the bore therebelow.

19 Claims, 11 Drawing Sheets

(51) Int. Cl.
*E21B 43/08* (2006.01)
*E21B 34/00* (2006.01)

(56) References Cited

U.S. PATENT DOCUMENTS

2008/0093080 A1* 4/2008 Palmer ..... E21B 21/103 166/318
2009/0056934 A1* 3/2009 Xu ..... E21B 43/26 166/244.1
2009/0056952 A1* 3/2009 Churchill ..... E21B 21/10 166/373
2009/0084553 A1 4/2009 Rytlewski et al.
2011/0114334 A1* 5/2011 Palacios ..... E21B 10/322 166/373
2011/0278017 A1* 11/2011 Themig ..... E21B 34/14 166/373
2012/0012322 A1* 1/2012 Korkmaz ..... E21B 34/14 166/308.1
2012/0234545 A1* 9/2012 Xu ..... E21B 43/26 166/308.1
2013/0043043 A1* 2/2013 Flores ..... E21B 34/14 166/373
2013/0048298 A1* 2/2013 Merron ..... E21B 34/14 166/373
2013/0062066 A1* 3/2013 Broussard ..... E21B 34/06 166/305.1
2014/0014340 A1* 1/2014 King ..... E21B 34/06 166/285
2014/0151054 A1* 6/2014 Norrid ..... E21B 34/14 166/318
2014/0262251 A1* 9/2014 O'Malley ..... E21B 33/1277 166/255.1
2014/0345876 A1* 11/2014 Coon ..... E21B 34/14 166/373
2014/0352970 A1* 12/2014 Kristoffer ..... E21B 43/12 166/318
2016/0115765 A1* 4/2016 Br Kke ..... E21B 34/14 166/318
2017/0275969 A1* 9/2017 Andrew ..... E21B 34/14
2017/0370185 A1* 12/2017 Saraya ..... E21B 34/063
2018/0347330 A1* 12/2018 Facca ..... E21B 34/14
2019/0071953 A1* 3/2019 Saraya ..... E21B 43/08
2019/0100980 A1* 4/2019 Fuxa ..... E21B 34/14

FOREIGN PATENT DOCUMENTS

RU 2316643 C2 2/2008
RU 2314415 C2 10/2008
WO 2014/011336 A1 1/2014

OTHER PUBLICATIONS

Russian Patent Application No. 2018108174 Notification on results of examination of the invention for patentability dated Feb. 6, 2020 (18 pages).

* cited by examiner

APPARATUS, SYSTEMS AND METHODS FOR MULTI-STAGE STIMULATION

CROSS-REFERENCE TO RELATED APPLICATIONS

This application is a 35 U.S.C. § 371 national stage entry of PCT/US2016/050426, filed Sep. 6, 2016 entitled "Apparatus Systems and Methods For Multi-Stage Stimulation," which claims the benefits of U.S. Provisional Application 62/214,843, filed Sep. 4, 2015, entitled "Multi-Stage Frac System With Sand Screen," the contents of each are hereby incorporated herein by reference in their entirety.

FIELD

Embodiments taught herein relate to apparatus, systems and methods for stimulating wellbores, and, more particularly are related to opening and closing of sleeve valves and further, to minimizing production of particulates, such as sand and debris, therethrough.

BACKGROUND

In the oil and gas industry, there are a number of well known systems for stimulating multiple zones or stages in a single trip. One such system utilizes balls, dropped from surface, to engage a sleeve in a sleeve valve blocking ports in a completion string to open the valves to permit stimulation of the formation through the ports. Ball seats on the sleeve valves engage the balls and pressure in the bore acts thereon to release and shift the sleeve downhole. Operations are generally performed from the toe of the wellbore to the heel. Typically, ports in a toe sub are opened, such as by pressure actuation, to permit pumping at least a first of the series of balls through the completion string.

The size of the ball seats incrementally increase from the toe to the heel. The smallest ball is dropped first to pass through all of the ball seats until it lands in the smallest ball seat at the toe and the bore is pressurized to shift the sleeve for opening ports therein. Stimulation, such as fracturing, is performed through the open ports. After the first stage has been stimulated, the next incrementally larger ball is dropped to land in the next uphole ball seat to shift the next sleeve valve for stimulating the next stage.

Such operations can be performed in open hole completions, where annular packers are positioned between stages to isolate the annular space between the completion string and the wellbore. Operations can also be performed in cemented completions where cement is used to fill the annular space for isolating between the stages.

To date, such systems have relied on the balls, engaged in the respective seats, to isolate the bore of the completion string below the stage being stimulated, preventing fluids from being directed and lost to the open ports therebelow. However, should the pressure upstream of the ball be sufficiently high, the pressure differential developed across the ball has been known to cause the ball to be extruded through the ball seat or the ball seat may fail, resulting in a loss of stimulation fluid to the open ports therebelow and the inability to effectively stimulate that stage. In this case, the operator can accept the failure of the ball/ball seat and move to the next stage, accept the failure and continue the stimulation in hopes some of the stimulation fluid enters the intended stage or drop another ball of the same size to try to shift the sleeve and stimulate the intended stage. In each case, time, complexity and costs increase. Efforts to prevent extrusion, such as increasing the size of each ball relative to the size of the respective seat or to decrease the size of the seat, has limited the incremental increases in ball size and hence, the number of stages that can be stimulated in a single operation. Further, if lower pressures are used to keep the pressure differential in a range to avoid extruding the balls, there may be insufficient pressure to perform the stimulation.

There is interest in the industry to be able to not only open sleeves but also to close sleeves. However in most prior art ball drop systems, the actuation is limited to a downhole action and therefore, it is not possible or practical to close the sleeve. An ability to close the sleeve permits much greater control over fluid delivery to and from the wellbore. It may be desirable to close the sleeve to allow the fractures to heal following treatment, to prevent sand, water and/or gas from entering the wellbore or to close off lower stages to prevent high differential pressures across the ball to minimize ball failure.

Accordingly, in the industry, conveyed shifting tools are known for opening and closing sleeve valves. Generally a shifting tool, having a profile formed thereon, is deployed into the completion string for engaging in a corresponding profile in the sleeve. Thereafter, the shifting tool is manipulated to push or pull the sleeve for opening and/or closing of the sleeve valve. Wellbore access for use of shifting tools in ball drop systems requires the stimulation operation to be stopped and the tool run in to the completion string to shift one or more sleeves and then tripped out of the wellbore. Such operations add to the cost and complexity of performing the stimulation operation.

One additional problem that is encountered in production after stimulation operations, particularly fracturing, is the large amount of sand or other particulates, including formation fines, produced with the hydrocarbon. Generally, surface equipment is used to separate sand from the produced fluid which adds to the overall cost of production. Downhole screens are known for use in operations such as Steam Assisted gravity Drainage (SAGD) and are generally installed on the outside of the horizontal sections of the production wellbore for production of fluids therealong. Further, screens are installed at the bottom of productions strings in wellbores known to produce large amounts of sand or in inflow control devices (ICD), which address non-uniform production profiles using a series of restrictions or nozzles therealong to maintain a more equal pressure drop from the formation to the wellbore for optimizing production therealong.

In fracturing operations, the presence of a screen extending over ports intended for delivering fracturing fluid including proppant therein, would render the ports inoperative. Production of sand-laden fluids, such as following a fracturing operation, would likely result in sanding off of the screen, particularly when a single screen is used at the end of the production string. Further still, nozzles in an ICD are unsuitable for delivery of fracturing fluids as the proppant would damage the restrictions as a result of erosion. Furthermore, as all ICD's remain open, it would not be possible to direct treatment fluid to one particular device at a time.

There is interest in the industry for systems and methods which allow ports to be closed following stimulating each stage without adversely affecting the efficiency of the stimulation operation. Further, there is interest in efficient and cost effective means for controlling sand production during production and more particularly following stimulation operations.

SUMMARY

Embodiments taught herein utilize a dual seat, downhole completion valve, system and methods of use for stimulation of wellbores. The dual seat valve has an upper sleeve and a lower sleeve and stimulation ports formed therebewteen. Each sleeve has a seat. The seat on the lower sleeve is a releasable seat. Progressively larger objects are pumped down the bore of the completion string to engage the seats for functioning of the valves. The seat on the upper sleeve of any given valve is functioned by the same object as is used to function the lower sleeve of the valve uphole therefrom. When the object is released from the releasable seat of the uphole valve, after shifting and opening stimulation poets at that stage, the object is pumped downhole to engage the seat in the upper sleeve at the stage therebelow. Thus, the same object that opened ports in the stage above is used to close ports in the stage below. When the ports in the stage below are closed stimulation fluid can be pumped through the stage above.

By closing the ports after each downhole stage is stimulated, all of the valves below the currently open valve are closed. This is advantageous, because objects are no longer required to seal off the bore below the stage being stimulated. This generally eliminates object failures due to high differential pressure exposure during treatment. Closing the sleeve after fracturing also allows the fractures to heal in the formation. Thereafter the ports can be re-opened for production using known techniques, such as a shifting tool.

In embodiments, where the number of objects to be dropped is not an issue, both the seat on the upper sleeve and the seat on the lower sleeve can be solid, non-releasable seats. Further, where the seat on the lower sleeve is a solid seat, the lowermost sleeve assembly in the wellbore may utilize the lower sleeve to close ports in a pressure actuated toe ports, thereby eliminating a separate toe sub.

In one broad aspect, a sleeve assembly for incorporating in a completion string used for a multi-stage stimulation operation comprises a tubular housing having a bore therethrough and stimulation ports therein for communicating fluid from the bore to outside the housing. A lower sleeve is axially moveable in the housing for blocking the stimulation ports in an initially closed position and has a first, releasable seat formed thereon for engaging an object received therein for shifting the lower sleeve for opening the stimulation ports. An upper sleeve, axially moveable in the housing, positioned uphole of the lower sleeve, has a second seat formed thereon to engage an incrementally larger object than that of the first seat, for shifting the upper sleeve downhole for blocking the ports in a closed position. Following shifting of the lower sleeve to the open the stimulation ports, the object is releasable from the first seat for engaging in the second seat of the upper sleeve of a like sleeve assembly positioned downhole thereof, for closing the stimulation ports therein.

In another broad aspect, a multi-stage completion system for a wellbore comprises a completion string in the wellbore having at least a first downhole stage and a second stage spaced uphole thereof, stimulation ports in the completion string at each stage being fluidly connected between a bore of the completion string and an annulus formed between the completion string and the wellbore. First and second sleeve assemblies are located at each of the at least first downhole and second uphole stages. Each sleeve assembly has a lower sleeve, actuable by a first object pumped down the completion string to open the ports therein and to release the object therefrom; and an upper sleeve, positioned uphole of the lower sleeve, actuable by a second, incrementally larger object pumped down the completion string to close ports therein. The first object, released from the lower sleeve of the uphole sleeve assembly after opening the ports therein, acts as the second object for actuating the upper sleeve in the downhole assembly to close the ports therein.

In a broad method aspect, a method for stimulating multiple stages in a wellbore having a completion string therein having a plurality of stimulation ports therethrough in at least an uphole stage and a downhole stage spaced therebelow, comprises opening ports adjacent a distal end of the completion string. An object is pumped through a bore of the completion string to the downhole stage for actuating a lower sleeve therein to shift downhole and open the stimulation ports therein. The object is released from the lower sleeve. The object is continued to be pumped through the bore. Stimulation fluid is pumped through the open stimulation ports in the downhole stage; and, if the stimulation operation is complete, a final incrementally larger object is pumped through the bore to actuate an upper sleeve in the downhole stage to shift downhole to close the stimulation ports therein.

When the stimulation operation is not complete after pumping stimulation fluid through the open stimulation ports in the downhole stage, an incrementally larger object is pumped through the bore of the completion string for actuating a lower sleeve in the uphole stage for shifting downhole for opening stimulation ports therein. The incrementally larger object is released from the lower sleeve and is continued to be pumped through the bore for actuating an upper sleeve in the downhole stage therebelow for shifting downhole for closing the stimulation ports therein. Stimulation fluid is pumped through the open stimulation ports in the uphole stage and the steps are repeated for subsequent stages to be stimulated, the size of the object being increased incrementally for each subsequent stage. When the stimulation operation is complete, a final incrementally larger object is pumped to actuate an upper sleeve in a final stage to close the stimulation ports therein.

In embodiments, a plurality of additional production ports can be provided in the valve housing, uphole from the stimulation ports. When the upper sleeve is shifted to close the stimulation ports, the production ports can be opened to produce the formation such as through screened ports. In this way, particulates, including but not limited to sand, proppant, formation fines and other debris can be minimized in the produced fluid.

In yet another embodiment, the additional ports can open to flow the produced fluids to an Inflow Control Device.

In another aspect, a sandscreen sub for incorporation into a completion string above, below or both above and below a conventional sleeve assembly or a sleeve assembly, according to an embodiment taught herein, comprises a tubular housing having a bore formed therethrough and internals slots formed in the housing. A screen is supported above an exterior of the tubular housing and covering the internals slots. A millable sleeve, formed inside the housing, has radially inwardly extending portions blocking fluid flow into and out of the bore through the internal slots, wherein following stimulation, the portions extending into the bore are milled out for exposing the internal slots for forming production ports therethrough, fluid entering the production ports through the screen for removing particulates therefrom.

In yet another embodiment, a sandscreen sub comprises a tubular housing having an upper portion, a lower portion and a bore formed therethrough. A screen housing is supported between the upper and lower housing portions and has production ports formed therethrough. A screen is supported over the screen housing and production ports and between the upper and lower housing portions. A millable sleeve is supported between the upper and lower housing portions at an interior of screen housing, the millable sleeve having a radially inwardly extending protrusion formed therein. The protrusion has a complimentary port formed therein which is closed at the bore which is thinned in cross-section. When the thinned portion of the protrusion is milled away, the complementary port is aligned with the production ports. Fluids produced from the formation pass through the screen the ports and into the bore for removing particulates therefrom.

BRIEF DESCRIPTION OF THE DRAWINGS

FIG. 2A illustrates an upper sleeve and a lower sleeve, each in an initial closed position, the lower sleeve blocking stimulation ports in the completion string;

FIG. 2C illustrates the upper sleeve shifted for closing the ports opened by shifting of the lower sleeve;

FIG. 3A illustrates the series of spaced apart sleeve assemblies, prior to initiating the stimulation operation, stimulation ports in each stage being blocked by the lower sleeve, the ports in the toe sub being opened by other means, such as pressure actuation;

FIG. 3B illustrates dropping a first smallest diameter object from surface for engaging in a first seat in the lower sleeve of a first sleeve assembly, immediately uphole of the toe assembly, for shifting the lower sleeve for opening the stimulation ports therein, the object thereafter being released from the first seat for engaging a seat on the sleeve in the toe assembly for shifting the sleeve to block the ports therein; and FIG. 3C illustrates dropping a second object from surface, the second object having a diameter incrementally larger than the first object, the second object engaging a first seat on the lower sleeve of a second sleeve assembly uphole of the first sleeve assembly for shifting the lower sleeve therein for opening the stimulation ports, the second object being released from the first seat and thereafter sealing in the second seat on the upper sleeve of the first sleeve assembly for shifting the sleeve therein to block the ports;

FIG. 7A illustrates an initial position wherein the lower sleeve initially blocks the stimulation ports and the upper sleeve initially blocks the production ports;

FIG. 7B illustrates the lower sleeve shifted to an open position for opening the stimulation ports in the completion string; and FIG. 7C illustrates the upper sleeve shifted for both closing the stimulation ports opened by shifting of the lower sleeve and for opening the production ports for producing fluids through the sandscreen assembly located annularly thereabout;

FIG. 10B illustrates the shifting sleeve blocking stimulation ports in the sleeve assembly and a sandscreen sleeve blocking production ports in the sandscreen sub when run into the completion string;

FIG. 100 illustrates the object, dropped from surface, sealing the seat and having shifted the shifting sleeve for opening the stimulation ports for delivering stimulation fluid to the formation therethrough;

FIG. 10D illustrates the sleeve assembly after milling out of the seat for removing restrictions in the bore of the completion string and after milling out the sandscreen sleeve for opening the production ports, fluid being produced into the bore through the sandscreen located on an exterior surface of the sandscreen sub; and FIG. 10E illustrates the shifting sleeve having been shifted to a closed position, such as with a shifting tool, after at least stimulation therethrough is completed.

DETAILED DESCRIPTION

Figure 1:
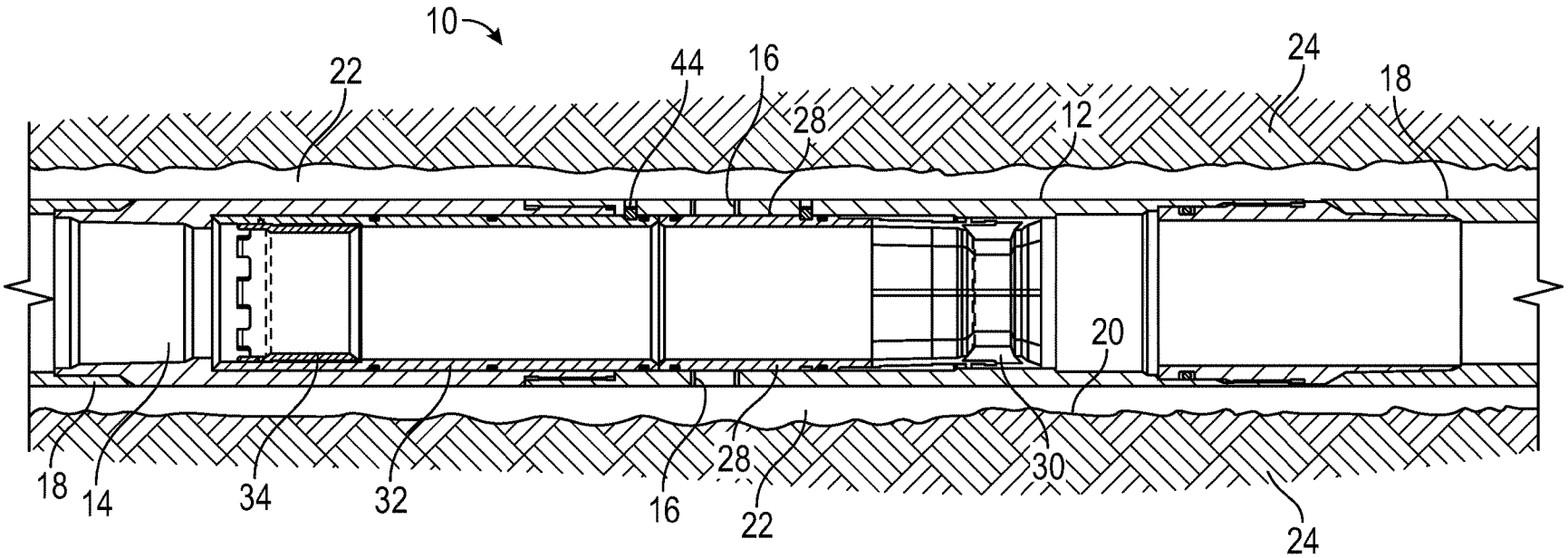
FIG. 1 is a cross-sectional view of an embodiment of a sleeve assembly according to an embodiment taught herein.

Embodiments taught herein are used for performing multi-stage stimulation operations. Embodiments of a sleeve assembly enable both opening and closing of stimulation ports by dropping objects, such as balls, darts or plugs, from surface. Further, embodiments also permit re-opening of the stimulation ports such as by using a shifting tool.

In further embodiments, shifting a sleeve to block the stimulation ports opens additional ports for production through a screen incorporated in the sleeve assembly.

In further embodiments, a screen assembly incorporates a millable sleeve in the bore of a sandscreen sub. The millable sleeve blocks production and/or stimulation through production ports in the sandscreen sub until such time as the sleeve is milled out. Milling can occur at the same time as when seats in the sleeve assemblies are milled out. The sandscreen subs are incorporated into the completion string below, above or both below and above each sleeve assembly.

The sandscreen subs can also be used in combination with conventional sleeve valves used for stimulation operations.

Having reference to FIGS. 1 to 3C, in embodiments a sleeve assembly 10, comprises a tubular housing 12 having a bore 14 formed therethrough. One or more stimulation ports 16 are formed in the tubular housing 12. The sleeve assemblies 10 are incorporated at intervals along a completion string 18 which is run into a wellbore 20, such as a directional wellbore. When open, the stimulation ports 16 permit fluid communication from the bore 14 to an annulus 22 formed between the completion string 18 and the wellbore 20. The intervals generally coincide with zones of interest or stages along a formation 24 to be stimulated, such as by fracturing, acidizing and the like. The annulus 22 can be cemented for isolating the stages from one another. Alternatively, where the completion is an openhole completion, annular packers 26 (FIGS. 3A-3C) can be set in the annulus 22 and spaced between each of the stages therealong.

As shown in FIG. 1, in an embodiment the tubular housing 12 is fit with a lower sleeve 28 having a first seat 30 formed thereon and an upper sleeve 32 having a second seat 34 formed thereon. The lower and upper sleeves 28,32 are moveable axially within the bore 14. The stimulation ports 16 are located uphole of the lower sleeve 28 and downhole of the upper sleeve 32. The lower sleeve 28 and upper sleeve 32 alternately open and close the stimulation ports 16.

Figure 2A:
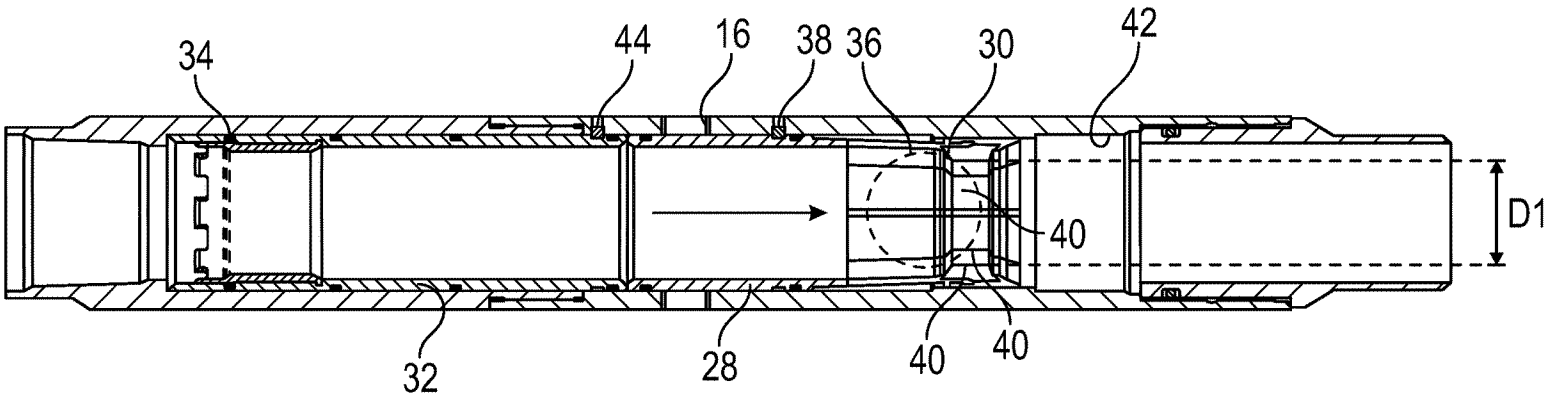
FIGS. 2A 2C are cross-sectional views of the sleeve assembly of FIG. 1 illustrating opening and closing of ports therein, more particularly.
Figure 2B:
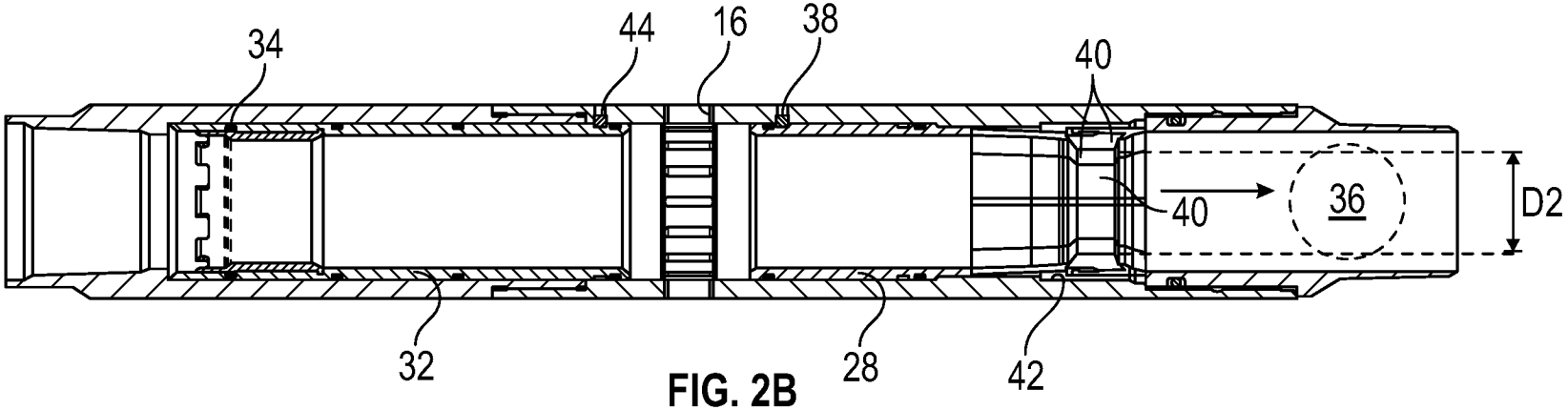
FIG. 2B illustrates the lower sleeve shifted to an open position for opening the stimulation ports in the completion string.
Figure 2C:
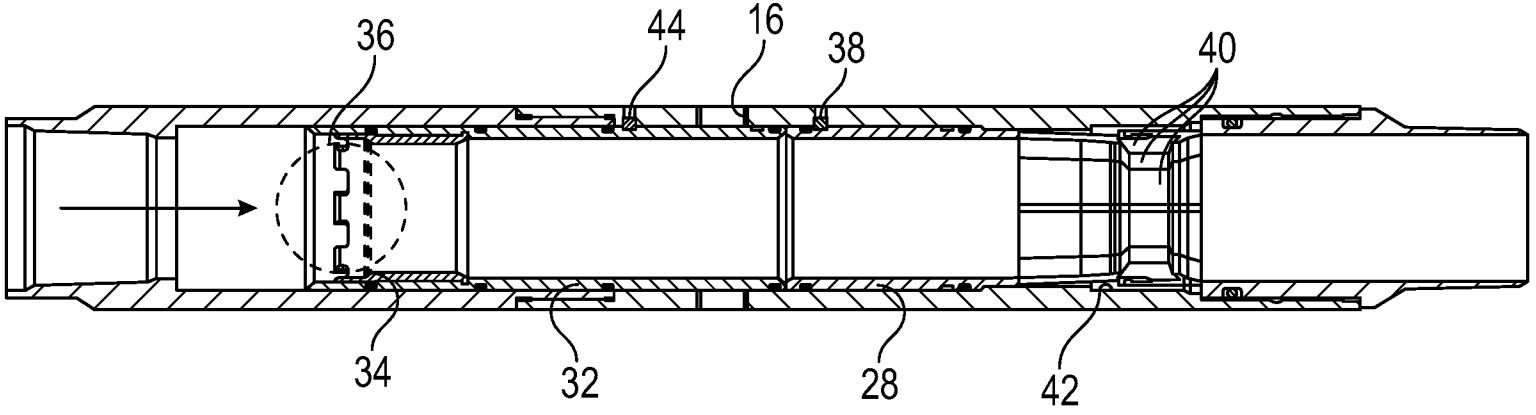

Operation of a single sleeve assembly 10 is described herein in relation to FIGS. 2A to 2C.

Having reference to FIGS. 1 and 2A, in an initially closed position, such as for running into the wellbore 20, the lower sleeve 28 blocks the stimulation ports 16 for preventing fluid communication between the bore 14 and the annulus 22. When the lower sleeve 28 is shifted axially to an open position, the stimulation ports 16 are open for establishing fluid communication between the bore 14 and the annulus 22.

The first seat 30 engages an object 36, such as a ball, dart or plug, pumped from surface. Fluid pressure in the bore 14 is increased, sufficient to apply force to the object 36 and seat 30 to cause shear screws or other means 38 releasably securing the lower sleeve 28 in the closed position, to fail for allowing the lower sleeve 28 to be shifted downhole for uncovering the stimulation ports in the open position (FIG. 2B). In an embodiment, the first seat 30 is a releasable seat, such as is known in the art, for releasing the object 36 therefrom when the lower sleeve 28 has shifted to the open position. One example of a releasable seat is taught in U.S. Pat. No. 8,215,401 to Braake.

In the embodiment shown, the releasable seat 30 is a flexible seat comprising a plurality of fingers 40 which are held together or restrained to a first diameter D1 suitable for forming the seat 30 when the lower sleeve 28 is in the closed position. When the lower sleeve 28 is shifted to the open position (FIG. 2B), the releasable seat 30 is shifted to a larger diameter portion 42 of the bore 14 which allows the fingers 40 to move radially apart to a second diameter D2 suitable to release the object 36 therefrom. The object 36 will travel downhole and can be used to actuate further downhole tools.

As shown in FIG. 2C, following stimulation through the open stimulation ports 16, a second, larger diameter object 36 is pumped into the bore 14 from surface for ultimately engaging in the second seat 34. Again, fluid pressure in the bore 14 is increased to apply sufficient force to cause shear screws 44, releasably securing the upper sleeve 32 in the initial position, to shear for releasing the upper sleeve 32 for shifting downhole to the closed position for blocking fluid communication through the stimulation ports 16.

In embodiments, the second seat 34 is a solid seat which retains the object 36 therein after shifting of the upper sleeve 32. However, as the stimulation ports 16 are closed, the object 36 is not necessarily required to seal the bore 14 therebelow, as described in greater detail below for a multi-stage stimulation operation. Thus, in embodiments, the second seat 34 can also be a releasable seat. However, the upper sleeve 32 is shifted to the closed position before the object 36 is released therefrom.

Having reference to FIGS. 3A to 3C and FIG. 4, a plurality of the sleeve assemblies 10 are positioned at intervals along the completion string 18 and which coincide with intervals or stages of interest in the formation 24.

As is well understood in the art, a toe sub 50 is positioned adjacent a distal end 52 of the completion string 18. The toe sub 50 comprises a tubular housing 51 having a bore 53 formed therethrough. Toe ports 54 in the housing 51, which are opened, such as by pressure actuation, provide a fluid flow path therethrough to permit pumping of at least a first object 36*a* into the bore 14. A toe sleeve 56 having a seat 58 formed thereon is retained in an initial position uphole of the toe ports 54, until such time as the first object 36*a* is engaged therein for shifting the toe sleeve 56 downhole for blocking the toe ports 54 in a closed position.

Progressively larger objects 36*a*,36*b* . . . are pumped downhole to perform the multi-stage stimulation of the wellbore 20 by functioning the plurality of sleeve assemblies 10*a*,10*b* . . . however, the second seat 34*a*,34*b* of any subsequent sleeve assembly 10*a*,10*b* is functioned by the same object 36*a*,36*b* as the earlier uphole or first releasable seat 30*a*,30*b* . . . of the sleeve assembly 10*b* positioned uphole therefrom.

In embodiments, where the number of objects 36 to be pumped is not an issue, both the first seat 30 and the second seat 34 can be solid, non-releasable seats. Further, where the first seat 30 on the lower sleeve 28 is a solid seat, the lowermost sleeve assembly in the wellbore may utilize the lower sleeve 28 to close ports in pressure actuated toe ports, thereby eliminating a separate toe sub 50.

Figure 4:
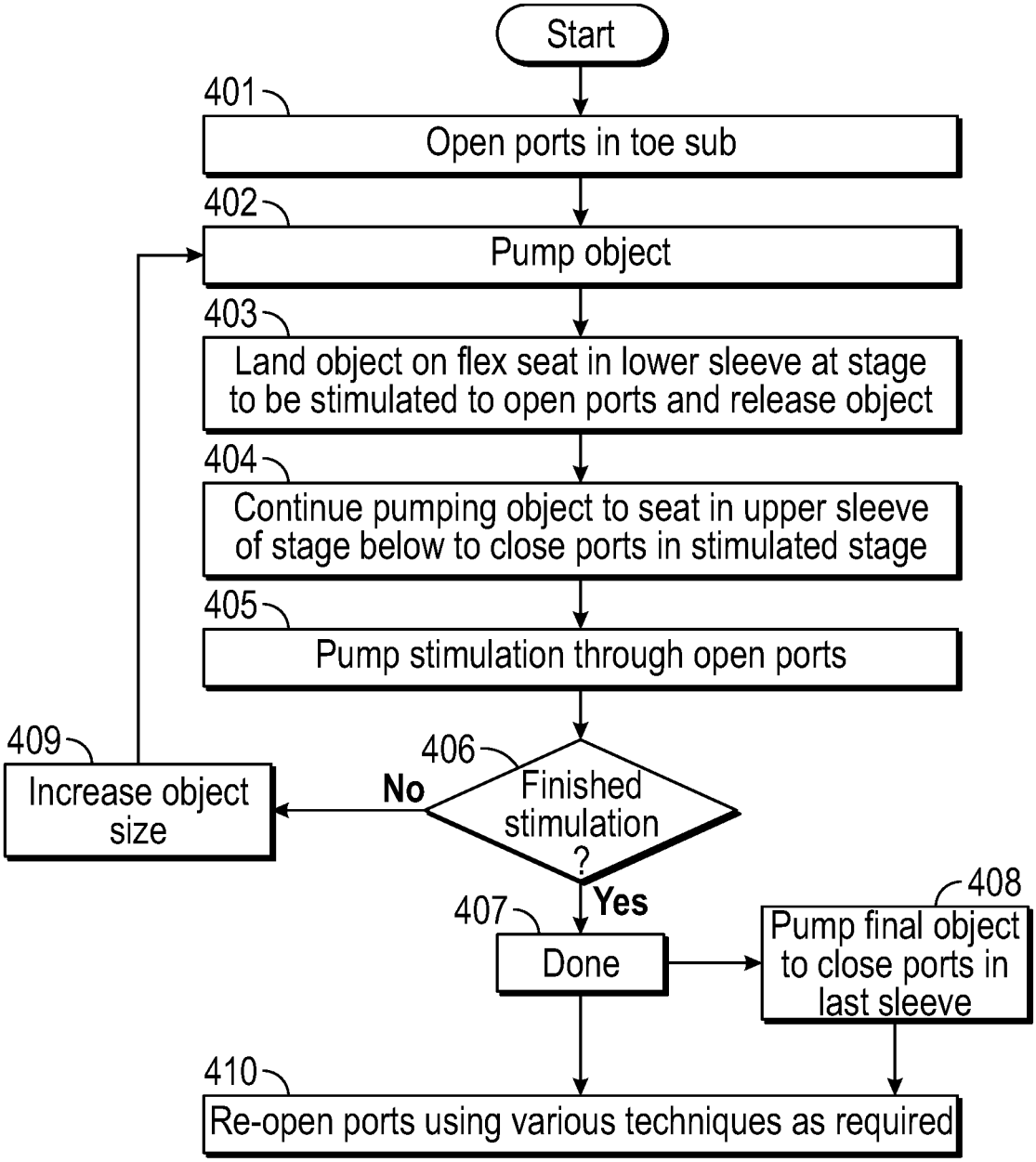
FIG. 4 is a flowchart illustrating a multi-stage stimulation operation using the sleeve assemblies of FIG. 1.
Figure 5:
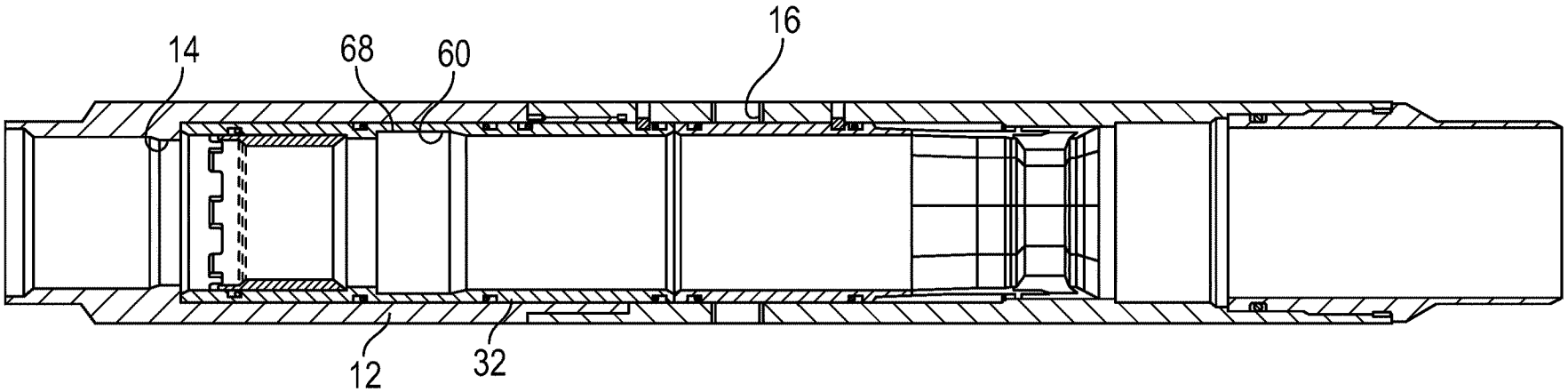
FIG. 5 is a cross-sectional view of an embodiment of a sleeve assembly having a profile for engaging a shifting tool for selectively opening the upper sleeve of any one of the series of sleeve assemblies.

Generally, and with reference to FIG. 4, to initiate a multi-stage simulation, at step 401, the toe sub is opened and at step 402, a first object is pumped. At step 403, the first object engages in the releasable seat in an uphole sleeve assembly to open the stimulation ports for that stage.

Pumping continues at step 404 to drive the object to the next downhole sleeve assembly, the stage thereat having already been stimulated, to engage the seat in the upper sleeve and close the stimulation ports therein.

At step 405, stimulation fluid is pumped through the open stimulation ports. At step 406, if the stimulation operation is finished at step 407, a final object is pumped at step 408 to close the stimulation ports in the last sleeve assembly.

If more sleeve assemblies are to be actuated, then at step 409 a next object is selected and the cycle is repeated to open an uphole sleeve assembly and close a subsequent, already stimulated downhole sleeve assembly.

At step 410, after the multi-stage stimulation operation is complete, one can re-open some or all of the ports for production from the formation.

Figure 3A:
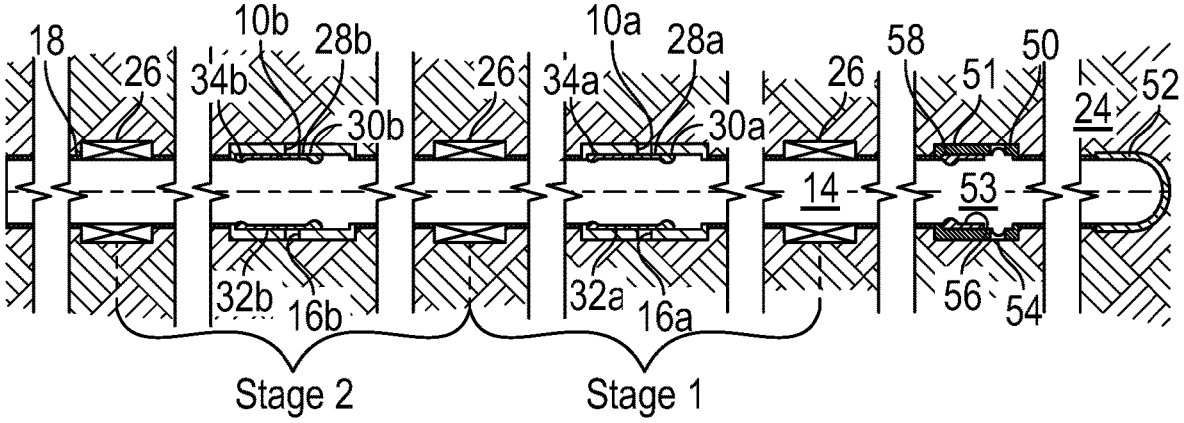
FIGS. 3A to 3C illustrate opening and closing of stimulation ports in each of a series of stages in a completion string, from a toe to a heel in a substantially horizontal portion of a directional wellbore in a formation, stages in an open hole completion being isolated from one another by annular packers positioned between the stages, by dropping a series of objects from surface, each stage having a sleeve assembly according to FIG. 1, except at the toe of the wellbore which has a toe assembly having only a single sleeve and ports therein, more particularly.

Now, with reference to the sleeve assemblies 10, as shown in FIG. 3A, a plurality of sleeve assemblies 10*a*, 10*b* . . . , positioned at intervals along a completion string 18 are isolated from one another using annular packers 26 in an openhole completion. In a cemented completion, the annular packers would be replaced by cement, substantially filling the annulus 22. The toe sub 50 is shown in an initial position having the toe sleeve 56 in the open position. In a first step, fluid pressure in the wellbore is increased to open the toe ports 54, such as by rupturing rupture disks or other pressure actuated means.

Figure 3B:
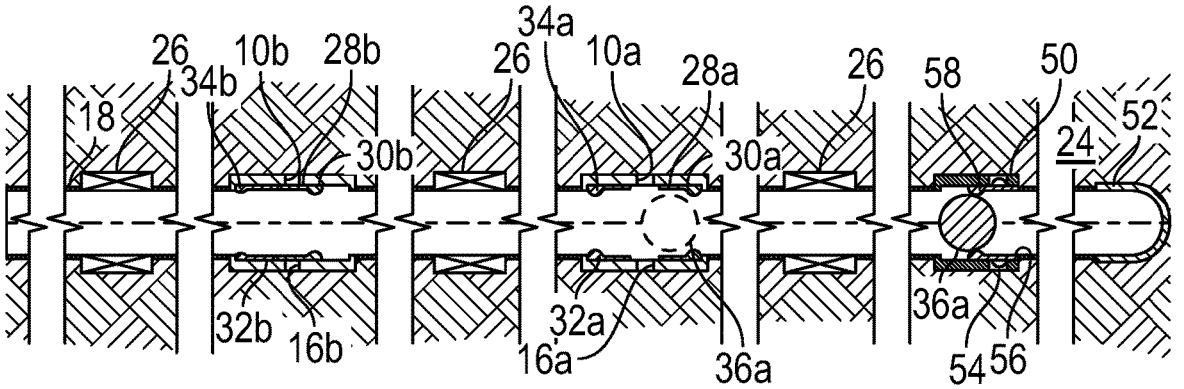

Thereafter, as shown in FIG. 3B, a first smallest diameter object 36*a* is pumped into the bore 14 of the completion string 18. The object 36*a* passes through all sleeve assemblies 10 uphole of a first sleeve assembly 10*a*, spaced above the toe sub 50. The first releasable seat 30*a* on the lower sleeve 28*a* of the first sleeve assembly 10*a* is sized to engage the smallest diameter object 36*a*. Once engaged therein, fluid pressure in the bore 14 acts on the first object 36*a* and releasable seat 30*a* to overcome the shear pins 38 holding the lower sleeve 28*a* for shifting the lower sleeve 28*a* to open the stimulation ports 16*a*. The first object is then released from the flexible seat and passes through the bore 14 until it seats in the seat 58 in the toe sub 50 which is sized to engage the first object 36*a* for shifting the toe sleeve 56 for blocking the toe ports 54.

Figure 3C:
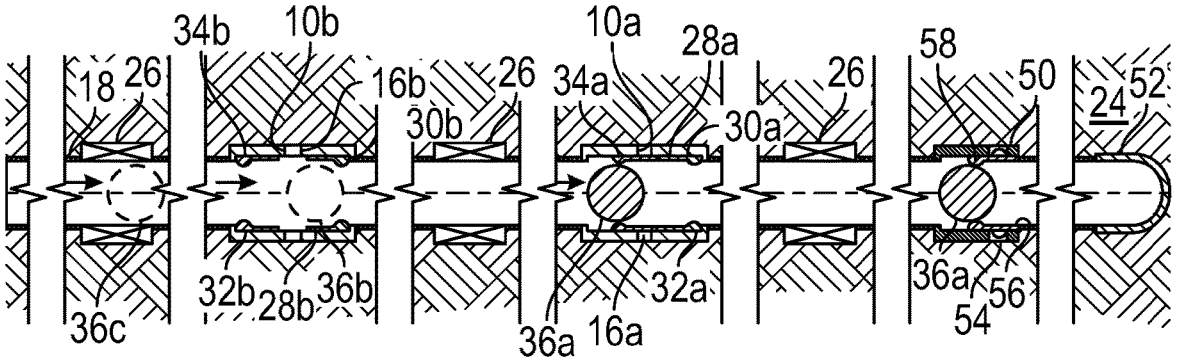

Having reference to FIG. 3C, following stimulation of the first stage through the first downhole sleeve assembly 10*a*, a second incrementally larger diameter object 36*b* is pumped down the bore 14. The second object 36*b* passes through uphole sleeve assemblies until the second object 36*b* reaches the releasable seat 30*b* in the lower sleeve 28*b* of the next uphole sleeve assembly 10*b*, which is sized to engage the second object 36*b*. The lower sleeve 28*b* is shifted downhole, to open stimulation ports 16*b* as described for the first sleeve assembly 10*a*, and the second object 36*b* is released from the releasable seat 30*b* therein. The second object 36*b* engages in the second seat 34*a* of the subsequent and downhole first sleeve assembly 10*a*. The second seat 34*a* is also sized to engage the second object 36*b*. The subsequent and downhole upper sleeve 32*a* is shifted, as described to close the stimulation ports 16*a* in the first sleeve assembly 10*a*. The process is repeated using a third and subsequent incrementally larger objects 36*c* . . . for opening stimulation ports in the remaining uphole sleeve assemblies 10 in the completion string 18.

As described above, the stimulation ports 16 are closed following stimulation of each stage and therefore there are no open stages below any further uphole stage being stimulated. Thus, in this embodiment, there is no reliance on the object 36, seated in the second seat 34 in the upper sleeve 32 of the stage therebelow to isolate the bore 14 therebelow. This eliminates issues related to object or seat failure, should the differential pressure thereacross, such as resulting from the stimulation, cause the object 36 to be extruded through the seat 34. The object 36, as described above, can be released from the second seat 34 or alternatively can be a dissolvable object.

One further advantage to closing all of the stimulation ports after stimulation of the formation therethrough, results from blocking the flow of fluids from the formation into the bore 14 of the completion string 18. The fluid, which may include proppant and the like, is retained within the formation 24 as it cannot flow back to the wellbore 20. As a result, the fractures formed as a result of the stimulation can "heal" with proppant therein, for optimizing later production of hydrocarbons therefrom.

Having reference to FIGS. 4 to 6B, stimulation ports 16 which have been closed following stimulating the wellbore 20 can be re-opened using a variety of techniques. In an embodiment, best seen in FIGS. 5 and 6B, the upper sleeve 32 further comprises a profiled recess 60 formed therein for engaging a shifting tool 62, an example of which is shown in FIG. 6A. Use of shifting tools 62 for opening sleeve valves is well known, such as B-type shifting tools, which have been used for both opening and closing shifting sleeves.

Figure 6A:
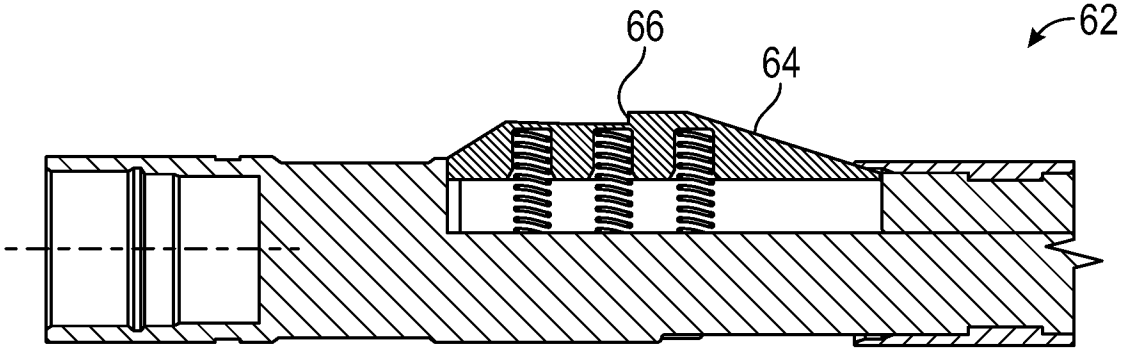
FIG. 6A is a cross-sectional view of an example of a shifting profile on a shifting tool for engaging the profile of the sleeve assembly of FIG. 5, the shifting tool being run into the completion string, such as on coiled tubing.
Figure 6B:
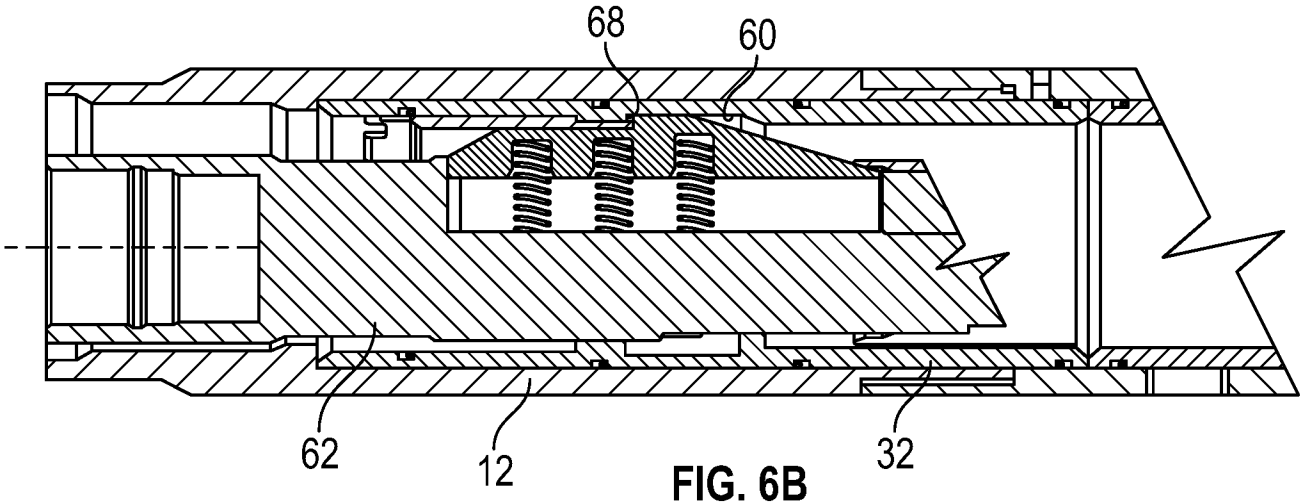
FIG. 6B is a partial cross-sectional view of the shifting tool of FIG. 6A engaged in the profile in the sleeve according to FIG. 5, a shoulder on the shifting profile engaged with a shoulder on the sleeve for pulling the shifting tool uphole and shifting the sleeve to the open position.

Having reference to FIG. 6B, a suitable shifting tool 62 is shown having a plurality of outwardly biased profiled dogs 64 retained thereon, the profile of the dogs 64 cooperating with that of the profiled recess 60 in the sleeve to be shifted. The shifting tool 62 is run into the wellbore, such as with coiled tubing or with jointed tubing on a service rig.

When the dogs 64 reach the profiled recess 60, the dogs are able to be biased outwardly into the profiled recess 60. For opening the upper sleeve 32, an outwardly extending, upwardly facing shoulder 66 on the dog 64 engages an outwardly extending, downwardly facing shoulder 68 in the recess 60. Thereafter, the shifting tool is lifted toward surface for shifting the upper sleeve 32 uphole for opening the stimulation ports 16.

As will be understood, as the shear screws 38,44 have already been sheared, other mechanisms may be included to hold the upper and lower sleeves 32, 28, once shifted using the object 36 or the shifting tool 62. In embodiments, snap rings, collets or the like can be used to retain the upper sleeve 32 or the lower sleeve 28, in the shifted position.

Figure 7A:
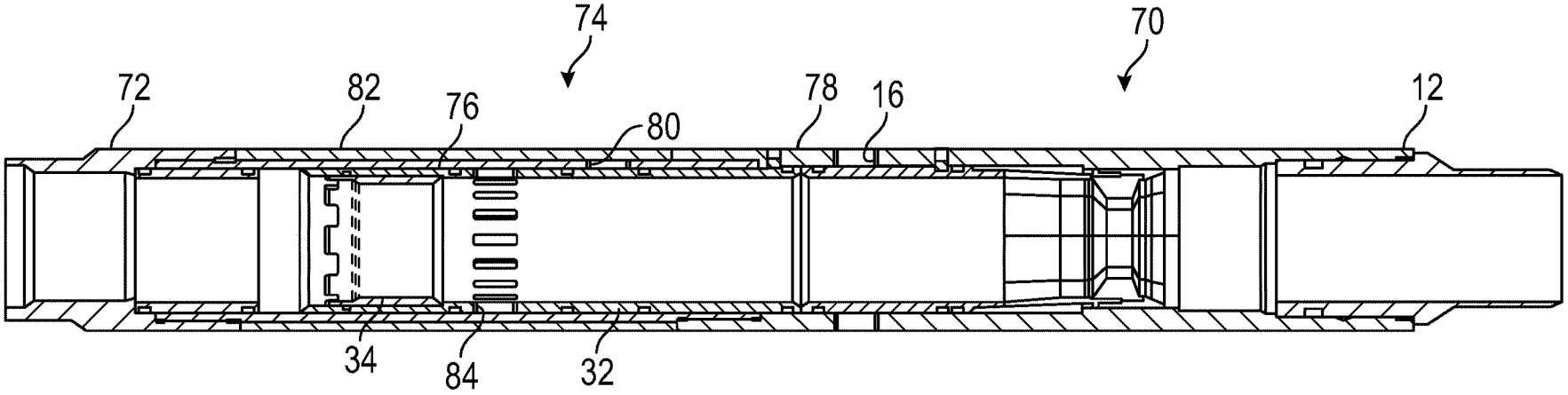
FIGS. 7A to 7C are cross-sectional views illustrating an embodiment of the sleeve assembly of FIG. 1, having a sandscreen incorporated therein and an additional set of production ports positioned uphole of the stimulation ports and further illustrate operation thereof, more particularly.
Figure 7B:
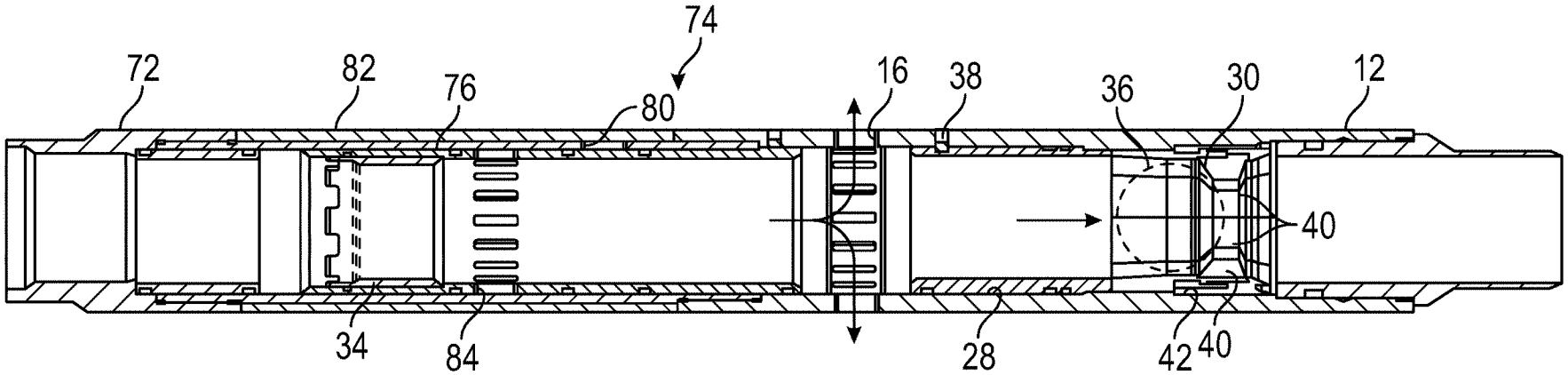
Figure 7C:
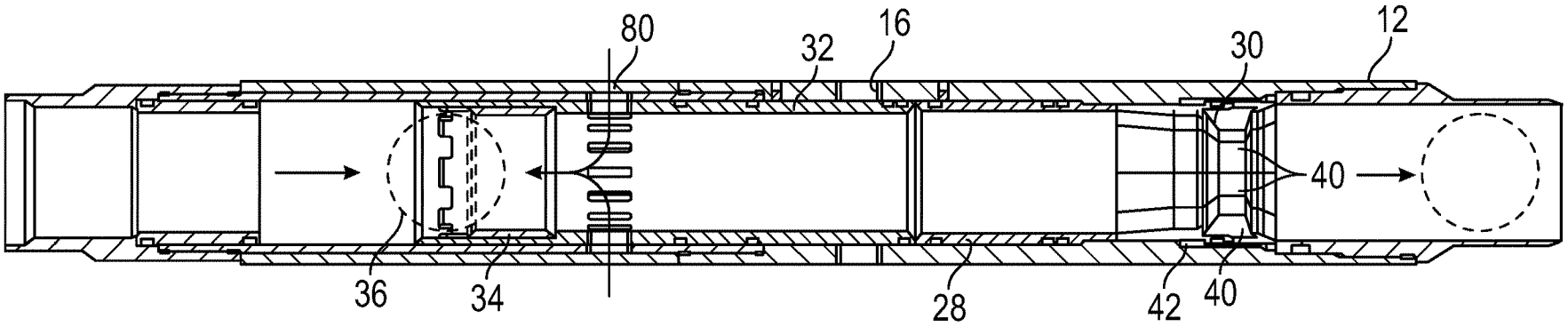

Turning to assemblies also configures for production of fluids from the formation and having reference to FIGS. 7A-7C, and in another embodiment, a screened sleeve assembly 70 comprises an upper portion 72 of the housing 12, above the stimulation ports 16, comprises a sandscreen assembly 74. A tubular screen housing 76 is supported between the upper housing 72 and a lower portion 78 of the housing 12 in which the stimulation ports 16 are formed. Production ports 80 are formed through the screen housing 76. A tubular screen 82 is supported over the screen housing 76, such as by connection to the housing 76, and the production ports 80 formed therein. The upper sleeve 32 further comprises ports 84 therein which are positioned uphole of the production ports 80 prior to the upper sleeve 32 being shifted to the closed position (FIG. 7A) and which are aligned with the production ports 80 (FIG. 7C) when the upper sleeve 32 is shifted downhole to the closed position to block the stimulation ports 16, as described above.

As shown in FIG. 7B, when the lower sleeve 28 has been shifted by landing an object therein, the stimulation ports 16 are opened however, the production ports 80 thereabove remain blocked as the upper sleeve 32 has not yet been shifted downhole and therefore, the production ports 80 and the sleeve ports 84 remain misaligned.

Having reference to FIG. 7C, when the production ports 80 and the sleeve ports 84 are aligned formation fluids flow through the screen 82, minimizing sand, proppant, formation fines and debris therein. In this embodiment, as a result of the open production ports 80 below the second seat 34 on the upper sleeve 32, unlike the previous embodiments, the object 36 engaged in the second seat 34 acts to seal and be retained in the seat 34 for isolating the bore 14 and open production ports 80 therebelow. Accordingly, pressure differential across the object 36 in the second seat 34 is considered when designing the multi-stage stimulation operation using this embodiment to retain the object 36 therein.

Advantageously, having the production ports 80 open following stimulation of the desired stages in the wellbore 20, the wellbore 20 can be immediately put into production. If the objects used to shift the sleeves are dissolvable, milling operations prior to production may not be required, resulting in additional cost savings. However, if production is being affected by the seats or if remedial work needs to be done, the seats can be milled out as required.

In another embodiment, restrictive ports, such as nozzles, can be installed in the production ports 80 to maintain a uniform flow therethrough, thereby acting as an inflow control device (ICD).

Figure 8:
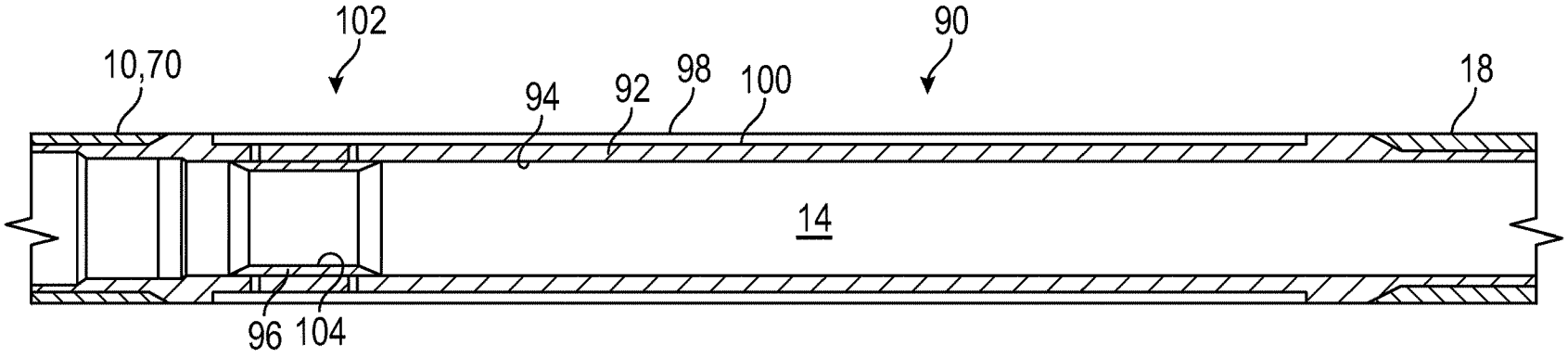
FIG. 8 is a cross-sectional view of an embodiment of a sandscreen sub for use in multi-stage completion operations, one or more of the sandscreen subs being incorporated into the completion string at each stage therein.
Figure 9:
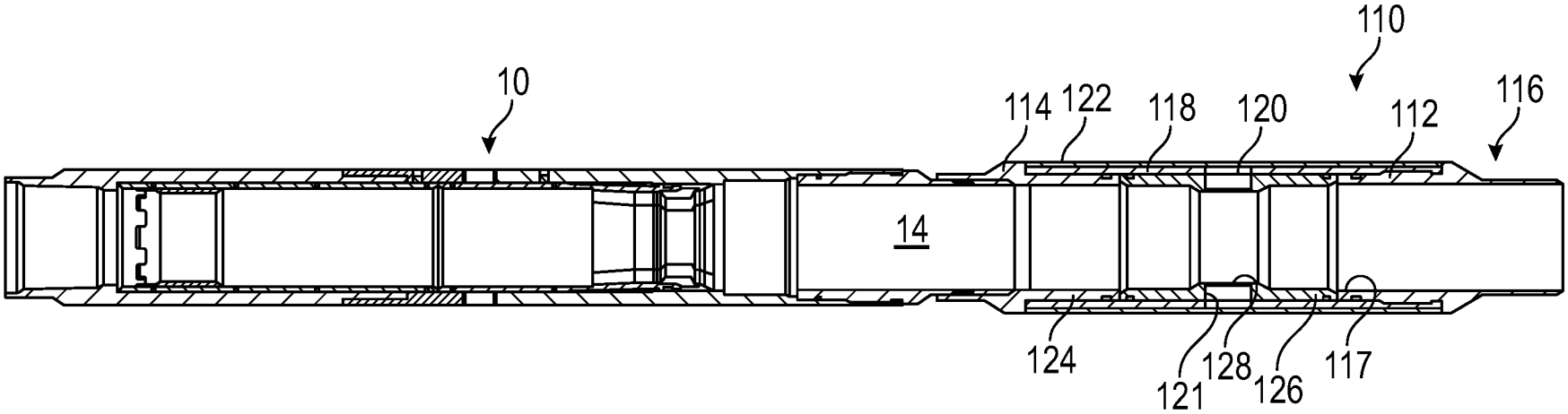
FIG. 9 is a cross-sectional view of another embodiment of a sandscreen sub, incorporated in the completion string downhole of the sleeve assembly of FIG. 1.

Having reference to FIGS. 8 and 9 and in yet another embodiment, a separate sandscreen sub 90 can be used in combination with either the sleeve assembly 10 or with the screened sleeve assembly 70, as described above. Further, the sandscreen sub 90 can be used with conventional shifting sleeve assemblies as described below in conjunction with FIGS. 10A-10E.

As shown in FIG. 8, an embodiment of the sandscreen sub 90 comprises a tubular housing 92 for incorporation into the completion string 18, above, below, or both above and below, the unscreened and screened sleeve assemblies 10,70. The tubular housing 92 has a bore 94 formed therethrough and internal slots 96 formed therethrough. A screen 98 is supported above an exterior 100 of the tubular housing 92 and covering the internals slots 96. A millable sleeve 102 is formed inside the housing 92 and has radially inwardly extending portions 104 that block fluid flow into and out of the bore 94 through the internal slots 96. Portions 104 extend into the bore 94 so that a milling tool can engage and remove same. Following stimulation of the desired stages of the wellbore, at least the radially inwardly extending portions 104 of the millable sleeve 102 are milled out for exposing the internal slots 96 for forming production ports. The milling of the millable sleeve 102 can be performed, such as when the seats are milled out.

Having reference to FIG. 9, an embodiment of a sandscreen sub 110 is shown incorporated into the completion string below a sleeve assembly 10 without a sandscreen. One or more of the sandscreen subs 110 can be incorporated into the completion string 18 either above or below the sleeve assembly 10 or both. The sandscreen sub 110, like the screened sleeve assembly 90 described above comprises a tubular housing 112 which has an upper portion 114 and a lower portion 116 and a bore 117 formed therethrough. A screen housing 118 is supported between the upper and lower housing portions 114,116 and has production ports 120 formed therethrough. A screen 122 is supported over the screen housing 118 and production ports 120 and between the upper and lower housing portions 114,116. A millable sleeve 124 is supported between the upper and lower housing portions 114,116 at an interior surface 126 of screen housing 118. The millable sleeve 124 has a radially inwardly extending protrusion 128 formed therein. The protrusion 128 has a complimentary port 121 formed therein and which is closed at the bore 14 which is thinned in cross-section. When the thinned portion of the protrusion 128 is milled away, the complementary port 121 is aligned with the production ports 120. Fluids produced from the formation 24 pass through the screen 122, through ports 120,121 and into the bore 117. The screen 122 removes particulates therefrom, including but not limited to proppant, sand, formation fines and debris.

Figure 10A:
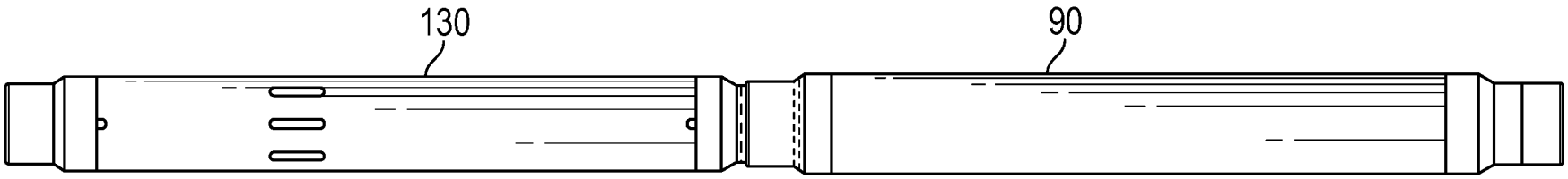
FIG. 10A is a side view of an embodiment of a sleeve assembly incorporating a shifting sleeve having a single, solid seat for opening stimulation ports using an object dropped from surface and sealed therein and further, incorporating an embodiment of the sandscreen sub of FIG. 8 into the completion string therebelow.

FIG. 10A illustrates an embodiment using a conventional sleeve assembly 130 in combination with the sandscreen sub 90, as shown in FIG. 8.

Figure 10B:
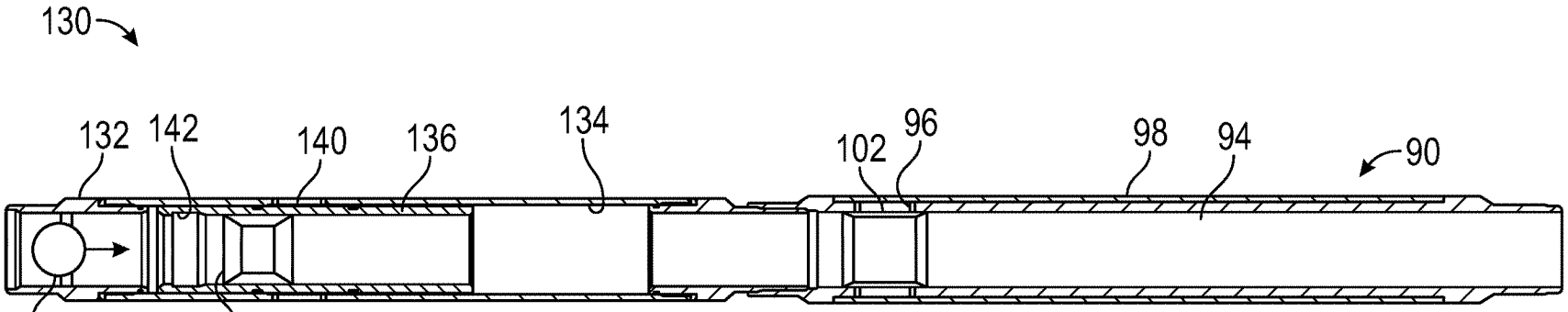
FIGS. 10B to 10E are cross-sectional views illustrating a stimulation operation using the sleeve assembly according to FIG. 10A, more particularly.
Figure 10C:
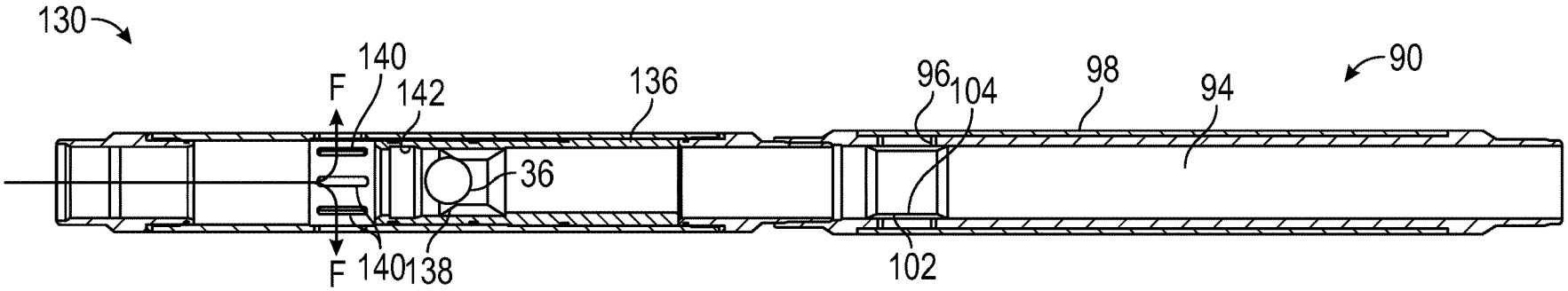
Figure 10D:
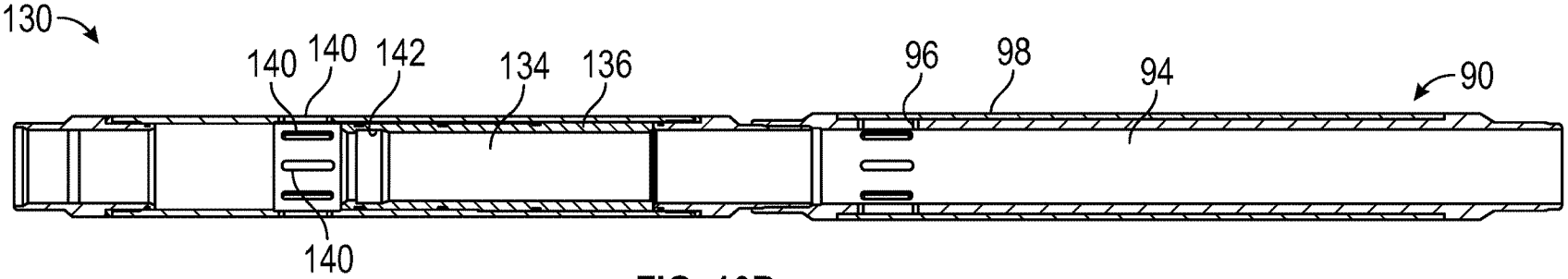
Figure 10E:
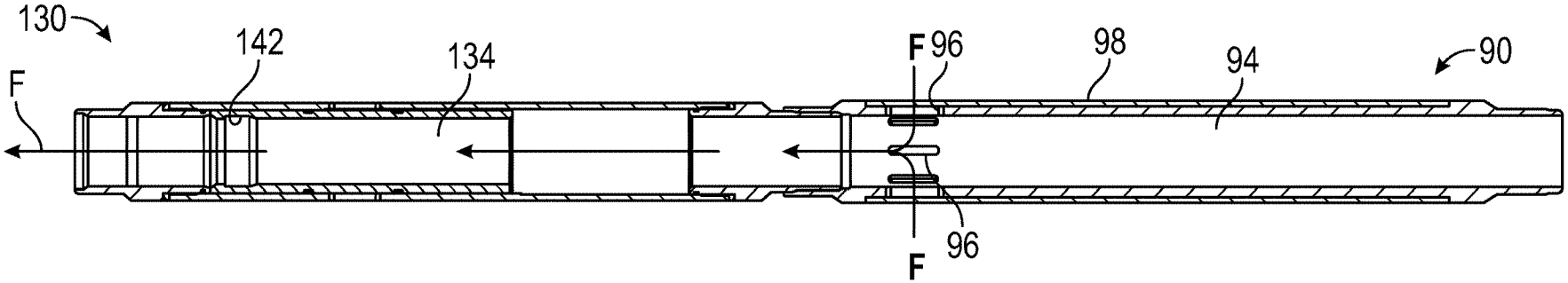

Having reference to FIGS. 10B 10E, the conventional sleeve assembly 130 comprises a tubular housing 132 having a bore 134 formed therethrough. The sleeve assembly 130 further comprises a single sleeve 136 having a seat 138 formed thereon which engages the object 36 pumped from surface to open stimulation ports 140 in the housing 132.

In this embodiment, the object 36 functions only to open the stimulation ports 140 and therefore, in a multi-stage stimulation operation, stimulation ports 140 are open downhole of the stage that is currently being stimulated. For this reason, the object 36 seals in the seat 138 for isolating the bore 134 therebelow.

As with the previous embodiments, in a multi-stage operation, a plurality of the conventional sleeve valves 130 are spaced apart along a completion string 18 as described, each having an incrementally increasing sized seat 138, uphole from a toe of the wellbore, for engaging incrementally increasing sized objects 36.

Having reference to FIG. 10B, the conventional sleeve assembly 130 is run into the wellbore 20 with the sleeve 136 held in the closed position, such as by shear screws, and blocking fluid flow to the stimulation ports 140. The millable sleeve 102 in the sandscreen sub 90, located above, below or both, blocks the flow of stimulation fluid to the formation through the internal slots 96 therein. The object 36 is pumped from surface into the completion string 18 for engaging and sealing in the seat 138.

Fluid pressure is increased in the wellbore, as shown in FIG. 100, for increasing the differential pressure across the object 36, for releasing the sleeve 136 and shifting the sleeve 136 downhole away from the stimulation ports 140. The object 36 remains sealed in the seat 138 below the stimulation ports 140 and stimulation fluid is delivered through the bore 134 and through the ports 140 to the formation 24. The operation is repeated for all of the desired stages in the wellbore.

Having reference to FIG. 10D, following completion of the multi-stage stimulation operations, the seats 138 are milled out for further opening the bore 134 for production of formation fluids therethrough. At the same time, the radially inwardly extending portions 104 of the millable sleeve 102 are also milled out for opening the internals slots 96 for forming the screened production ports.

Further, as shown in FIG. 10E, the sleeve 136 in the sleeve assembly 130 is shifted to the closed position using a shifting tool 62, such as shown in FIG. 6A however having an appropriate profile for closing the sleeves 136, which engages in a profile 142 formed in the sleeve 136 for blocking flow of formation fluid F into the bore 134 through the stimulation ports 140. Sleeves 136 are generally shifted to the closed position in a single run of the shifting tool 62, beginning at the toe of the wellbore. In embodiments, the sleeves 136 are locked in the closed position, such as by snap rings collets and the like and which are not shown.

In embodiments, the milling of the seats 138 and the millable sleeves 102 and shifting of the sleeves 136 to the closed position is performed in a single run.

Formation fluid F then enters the screened production ports 96 through the screen 98, thereby minimizing the amount of sand, proppant, formation fines, debris and the like produced with the formation fluid F at surface.

What is claimed is:

1. An assembly for incorporating in a completion string comprising:

a tubular housing having a bore therethrough and stimulation ports therein for communicating fluid from the bore to outside the housing;

a lower sleeve axially moveable in the housing for blocking the stimulation ports when the lower sleeve is positioned in an initially closed first position and having a first, releasable seat formed thereon, the first seat configured to engage an object received therein and to shift the position of the lower sleeve to a second position in which the stimulation ports are open; and an upper sleeve, axially moveable in the housing, positioned uphole of the lower sleeve and having a second seat formed thereon, the second seat configured to engage an incrementally larger object than that of the first seat and to shift the upper sleeve downhole from a third position in which the stimulation ports are open to a fourth position in which the upper sleeve blocks the stimulation ports;

wherein, the first seat in the lower sleeve is further configured to, following shifting of the lower sleeve to the second position, release the object from the first seat for engaging in the second seat of the upper sleeve of a like assembly positioned downhole thereof, for closing the stimulation ports of the like assembly positioned downhole;

a plurality of sleeve production ports formed in the upper sleeve downhole of the second seat; and a screen assembly supported in an upper portion of the housing, the screen assembly having:

a tubular screen housing having a plurality of housing production ports therein; and a tubular screen supported about the screen housing and covering the plurality of housing production ports, wherein the screen assembly is configured such that, prior to shifting the upper sleeve to the fourth position, the sleeve production ports are misaligned from the housing production ports so as to block fluid flow therethrough; and the screen assembly is configured such that, after shifting the upper sleeve to the fourth position, the sleeve production ports are aligned with the housing production ports so as to allow formation fluid to flow through the screen to the bore.

2. The assembly of claim 1 wherein the first seat is a flexible seat configured to receive and retain the object when in the first position in the housing and to allow the object to pass therethrough upon the first seat being moved to the second position in the housing that is axially downhole from the first position.

3. The assembly of claim 2 wherein the flexible seat comprises:

a plurality of fingers restrained to a first diameter for forming the flexible seat, and wherein the bore comprises a larger diameter portion such that when the lower sleeve is shifted for opening the stimulation ports, the fingers, positioned in the larger diameter portion move radially apart to a second diameter for releasing the object therefrom.

4. The assembly of claim 1 wherein the second seat is a solid seat for retaining the incrementally larger object therein.

5. The assembly of claim 1 wherein the second seat is a flexible seat, configured to retain the incrementally larger object therein until at least the upper sleeve is shifted to the fourth position.

6. The assembly of claim 1 wherein at least the upper sleeve has a profile therein for engagement by a shifting tool for shifting the upper sleeve uphole, from the closed fourth position to the open third position.

7. A multi-stage completion system for a wellbore comprising:

a completion string having at least a first downhole stage and a second uphole stage spaced uphole from the first downhole stage, each of the downhole stage and uphole stage having:

a tubular housing;

stimulation ports in the housing being fluidly connected between a bore of the completion string and an annulus formed between the completion string and the wellbore; a lower sleeve axially moveable in the housing, configured to be actuable by a first object pumped down the completion string to open the stimulation ports in the housing; and an upper sleeve axially moveable in the housing, positioned uphole of the lower sleeve, configured to be actuable by a second, incrementally larger object pumped down the completion string to close the stimulation ports in the housing;

wherein the lower sleeve of each stage further comprises a first, releasable seat formed thereon, the first seat configured to engage the first object therein and to shift the lower sleeve to a position that opens the stimulation ports in the housing and to thereafter release the first object therefrom; and wherein the upper sleeve of each stage further comprises a second seat formed thereon, the second seat configured to engage the second incrementally larger object and to shift the upper sleeve downhole to a position that blocks the stimulation ports in the housing; and wherein the second seat on the upper sleeve of the downhole stage is sized to receive and engage the same sized object as the releasable seat on the lower sleeve of the uphole stage, the upper sleeve of the downhole stage being configured to close the stimulation ports in the downhole stage upon the first object being received in the second seat of the upper sleeve of the downhole stage after the first object has been released from the lower sleeve of the uphole stage.

8. The multi-stage completion system of claim 7 further comprising:

a toe sub positioned adjacent a distal end of the completion string, the toe sub having a tubular housing having a bore therethrough;

toe ports formed in the housing for providing a flow path from the bore to the annulus when opened for pumping fluid from the bore of the completion string therethrough;

a toe sleeve retained uphole of the toe ports in an initial position; and a seat formed on the toe sleeve configured to engage the first object when released from the lower sleeve of the downhole stage and to shift the toe sleeve to a closed position blocking the toe ports.

9. The multi-stage completion system of claim 8 wherein the toe ports are opened by pressure actuation.

10. The multi-stage completion system of claim 7 wherein each of the uphole and downhole stages further comprises:

a plurality of sleeve production ports formed in the upper sleeve downhole of the second seat; and a screen assembly supported in an upper portion of the housing, the screen assembly having a tubular screen housing having a plurality of production ports therein; and a tubular screen supported about the screen housing and covering the plurality of housing production ports, wherein the screen assembly is configured such that, prior to shifting the upper sleeve to the position in which it blocks the stimulation ports, the sleeve production ports are misaligned from the housing production ports so as to block fluid flow therethrough; and the screen assembly is configured such that, after shifting the upper sleeve to the position in which it blocks the stimulation ports, the sleeve production ports are aligned with the housing production ports so as to allow formation fluid to flow through the screen to the bore.

11. The multi-stage completion system of claim 7 wherein each of the first seats is a flexible seat configured to receive and retain the first object when in a first position in the housing and to allow the first object to pass therethrough upon the seat being moved to a second position in the housing that is axially downhole from the first position.

12. The multi-stage completion system of claim 11 wherein the flexible seat comprises:

a plurality of fingers restrained to a first diameter for forming the flexible seat, and wherein the bore comprises a larger diameter portion such that when the lower sleeve is shifted for opening the stimulation ports, the fingers, positioned in the larger diameter portion move radially apart to a second diameter for releasing the first object therefrom.

13. The multi-stage completion system of claim 7 wherein each of the second seats is a solid seat for retaining the incrementally larger object therein.

14. The multi-stage completion system of claim 7 wherein each of the second seats is a flexible seat, configured to retain the incrementally larger object therein until at least the upper sleeve is shifted to the position in which it blocks the stimulation ports.

15. The multi-stage completion system of claim 7 wherein at least the upper sleeve has a profile therein for engagement by a shifting tool for shifting the upper sleeve uphole, from the closed position in which it blocks the stimulation ports to a position in which the stimulation ports are not blocked.

16. The multi-stage completion system of claim 7 further comprising one or more sandscreen subs incorporated into the completion string above, below, or both above and below each stage.

17. The multi-stage completion system of claim 16 wherein the sandscreen sub comprise:

a tubular housing having a bore formed therethrough;

a plurality of internal slots in the tubular housing;

a screen supported about an outside of the housing and covering the internal slots; and a millable sleeve having radially inwardly extending portions configured to block fluid flow into and out of the bore, wherein at least the radially inwardly extending portions of the millable sleeve are removable for exposing the internal slots and forming production ports for producing formation fluids through the screen and production ports and into the bore.

18. A method for stimulating multiple stages in a wellbore having a completion string therein, the completion string having a bore and a plurality of stimulation ports therethrough and having at least an uphole stage, a downhole stage spaced below the uphole stage, and a distal end below the downhole stage, the method comprising:

opening stimulation ports adjacent the distal end of the completion string;

pumping a first object through the bore to the uphole stage and shifting a lower sleeve of the uphole stage to move to a downhole position and open the stimulation ports in the uphole stage;

releasing the first object from the lower sleeve of the uphole stage;

continuing pumping the first object through the bore;

after the first object has been released from the lower sleeve of the uphole stage, using the first object, shifting an upper sleeve of the downhole stage to a downhole position and closing the stimulation ports in the downhole stage;

pumping stimulation fluid through the open stimulation ports in the uphole stage;

pumping an incrementally larger object through the bore to the whole stage and shifting an upper sleeve in the uphole stage to move to a downhole position and close the stimulation ports in the uphole stage;

repeating the steps for subsequent stages to be stimulated, wherein the size of the object is increased incrementally for each subsequent stage; and performing a final step of pumping a final incrementally larger object to actuate an upper sleeve in a final stage to close the stimulation ports in the final stage.

19. The method of claim 18, further comprising: after closing the stimulation ports in the final stage, re-opening the stimulation ports for producing formation fluids therethrough.

* * * * *